US005098757A

United States Patent [19]

Steel

[11] Patent Number: 5,098,757

[45] Date of Patent: Mar. 24, 1992

[54] TEAR TAPE OPENING SYSTEM

[75] Inventor: Thomas C. Steel, Malverne, N.Y.

[73] Assignee: H.B. Fuller Company, St. Paul, Minn.

[21] Appl. No.: 439,644

[22] Filed: Nov. 20, 1989

Related U.S. Application Data

[63] Continuation-in-part of Ser. No. 13,373, Feb. 11, 1987.

[51] Int. Cl.[5] ..... B65D 3/26; B32B 31/08; B32B 3/08

[52] U.S. Cl. ..... 428/34.2; 428/77; 428/136; 428/182; 156/301; 229/206; 229/235; 229/238

[58] Field of Search ..... 428/34.2, 77, 136, 182, 428/43; 206/606, 605, 615; 156/301

[56] References Cited

U.S. PATENT DOCUMENTS 4,773,541 9/1988 Riddell ..... 206/606

*Primary Examiner*—Alexander S. Thomas
*Attorney, Agent, or Firm*—Collard, Roe & Galgano

[57] ABSTRACT

A tear tape opening system is provided for establishing an opening in a package or carton formed of corrugated board wherein the corrugated board consists of an outside liner, an inside liner and a corrugating medium thereinbetween, wherein the outside liner has outside and inside surfaces and the inside liner has outside and inside surfaces, and the inside surfaces of the outside and inside liners face the corrugating medium. The tear tape opening system according to the present invention includes a hot melt coated tear tape adhered to the outside surface of the inside liner along the desired line of opening and a hot melt coated tear guide tape, at least as wide as the tear tape, adhered to the inside surface of the outside liner along the desired line of opening so as to guide the tear formed by the tear tape and reinforce and stabilize at least one edge of the tear along the outside surface of the outside liner. The tear tape opening system is incorporated in the corrugated board in the doublebacker segment of the corrugator board forming machine. In order to prevent smearing or transfer of the softened hot melt from the tear tape to the pressure belt of the doublebacker, a paper backed hot melt coated tape is utilized, or a differential hot melt is used wherein a high temperature hot melt, unaffected by the hot plates of the doublebacker, is used to coat the surface of the tear tape in contact with the pressure belt.

13 Claims, 2 Drawing Sheets

TEAR TAPE OPENING SYSTEM

This is a continuation-in-part of co-pending application Ser. No. 013,373, filed Feb. 11, 1987, entitled "TEAR TAPE OPENING SYSTEM".

The present invention relates generally to a tear tape opening system for a carton or package formed of corrugated board and, more particularly, it relates to such a system wherein at least one edge produced by the opening system at the outside surface of the outside liner board of the corrugated board packaging material is evenly torn without any unevenness therealong resulting from the tearing operation.

A similar type of opening system is disclosed in co-pending application Ser. No. 013,373, filed Feb. 11, 1987, entitled "A TEAR TAPE OPENING SYSTEM". In this referenced application, there is disclosed a tear tape opening system for use with packages formed of kraft paper, paper board, or corrugated board. The major benefit derived from the opening system covered by the above-identified application is to provide reinforcing along the tear line or lines in the outside surface of the material forming the package, so as to prevent uneven tearing or delamination of the packaging material at or along the tear line. The system disclosed in this prior application consists of a tear tape in the form of hot melt coated tape or string adhered along the inside surface of the package material, along the desired tear line of the opening system, together with a tear guide system consisting of one or a plurality of tapes arranged on the outside surface of the package material along the desired line of tear and which guides the tear produced by the tear tape so as to prevent uneven tearing of the package forming material. Furthermore, in connection with packages formed of corrugated board, this prior application teaches, in addition to disposing the tear guide system on the outside surface of the corrugated board, that it is possible to arrange the guide tape or tapes on the inside surface of the outside liner and that it is possible to provide the tear tape on the inside or outside surface of the inside liner board.

In connection with employing the tear tape opening system according to the above-identified application with a package or carton formed of corrugated board, it is not possible to utilize a hot melt coated tape for the tear guide system on the outside surface of the corrugated board since these tapes are applied at the doublebacker section of the corrugation forming machine or corrugator when the outside liner is incorporated in the formation of the corrugated board. The outside liner is incorporated in the corrugated board with the use of hot plates which press the outside liner against the flutes of the corrugating medium and the heat activates the adhesive on the flutes to thereby adhere the outside liner thereto. Thus, if a hot melt coated tape were also applied at this point, the heat of the hot plates would cause the hot melt to soften and smear, resulting in an unsightly package and unworkable tear guide system. Alternatively, as indicated in the prior application, the tear guide tape can be applied in the form of a hot melt coated tape to the inside surface of the outside liner at the doublebacker of the corrugator. However, in this latter application when the tear tape is pulled through the corrugated board, the outer surface of the outside liner at the tear line may become unevenly torn since there is no reinforcement at the outer surface to reinforce the edge of the tear. This drawback is particularly problematic where the outside liner is coated for the purpose of accepting printing thereon, since this coating tends to flake and become broken when torn through by the tear tape. Because of the poor results obtained in such an opening system for a carton or package formed of corrugated board relative to the unevenness of the edges along the tear line, the opened carton itself is too unsightly to be utilized in a consumer display of the product. Therefore, a retailer must go through the labor intensive operation of unpacking the carton and stocking the store shelves.

A tear tape opening system specifically for packages formed of corrugated board, is disclosed in co-pending application Ser. No. 201,485, filed June 1, 1988. According to the disclosure therein, a hot melt coated tear tape is disposed on the outside surface of the inside liner along the desired tear line and a wider guide tape is disposed on the outside surface of the outside liner overlying the tear tape. The guide tape is provided with a paper backing so that the hot melt coating of the tape is not smeared during forming of the corrugated board by the hot plates of the corrugator which are used to join the outside liner to the corrugating medium. Such a tear tape opening system overcomes the problems relating to unevenness, etc. of the resulting torn edge of a corrugated board package. However, this system requires that the paper backed guide tape be located on the exterior of the shipping carton. This necessarily detracts from the appearance of the carton which is intended to be used in displaying the product when opened.

It is, therefore, a primary object of the present invention to provide a tear tape opening system for establishing an opening in a carton or package formed of corrugated board, whereby at least one of the edges of the tear line at the outside surface of the outside liner of the corrugated board is reinforced so as to be stabilized during the opening procedure to result in an even torn edge therealong and to also provide a reinforced edge for the resulting open container for display purposes.

The above object is accomplished in accordance with the present invention by providing a tear tape opening system for creating an opening in a package or carton formed of corrugated board wherein the corrugated board consists of an outside liner, an inside liner and a corrugating medium thereinbetween, wherein the outside liner has outside and inside surfaces and the inside liner has outside and inside surfaces, and the inside surfaces of the outside and inside liners face the corrugating medium. The tear tape opening system according to the present invention includes a hot melt coated tear tape adhered to the outside surface of the inside liner along the desired line of opening and a hot melt coated tape, at least as wide as the tear tape, adhered to the inside surface of the outside liner along the desired line of opening overlying at least one edge of the tear tape with the opposing edge of the tear tape preferably in registration with an edge of the tear guide tape, so as to guide the tear formed by the tear tape and reinforce and stabilize at least one of the edges of the tear along the outside surface of the outside liner. An opening pull tab is formed by a pair of die cuts formed at an edge of the corrugated board wherein at least one intersects the overlying portions of the tear tape and tear guide tape.

Since the tear tape is applied to the outside surface of the inside liner, provision must be made to prevent smearing of the hot melt or transfer to the blanket or belt that compresses the board as the board moves through the doublebacker segment of the corrugated board forming machine. Such smearing or transfer to the belt can be prevented by using a paper backed tape or differential hot melt having a higher temperature hot melt facing the belt.

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

Figure 1:
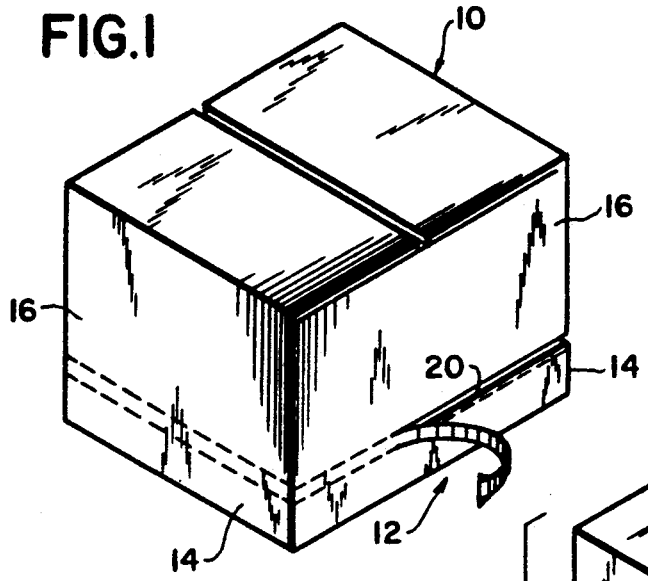
FIG. 1 is a perspective view of a carton having the tear tape opening system according to the present invention.
Figure 2:
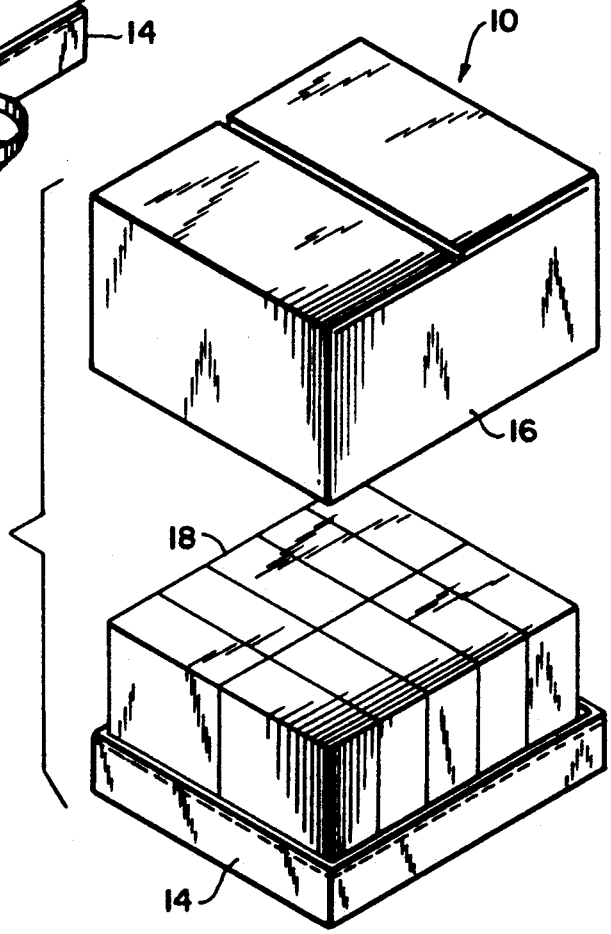
FIG. 2 is a perspective view of the carton of FIG. 1, subsequent to being opened by the tear tape opening system with the sections of the carton shown exploded and the product therein arranged in a consumer display.

Now turning to the drawings, there is shown in FIG. 1 a carton, designated 10, having a horizontally disposed tear tape opening system 12 passing circumferentially throughout the periphery thereof and dividing the carton into a lower section 14 and an upper section 16. Thus, lower and upper sections 14 and 16, respectively, can be separated from each other as shown in FIG. 2 and the lower section utilized as a tray for the product 18 packaged in carton 10 in a consumer display. However, in order for lower section 14 of carton 10 to be utilized together with the product 18 contained in the carton in such a consumer display, the tear line 20 of lower section 14 resulting from the operation of the tear tape opening system 12 must be straight and even without any tears or breaks in the outside surface of the outside liner of the corrugated board.

Figure 3:
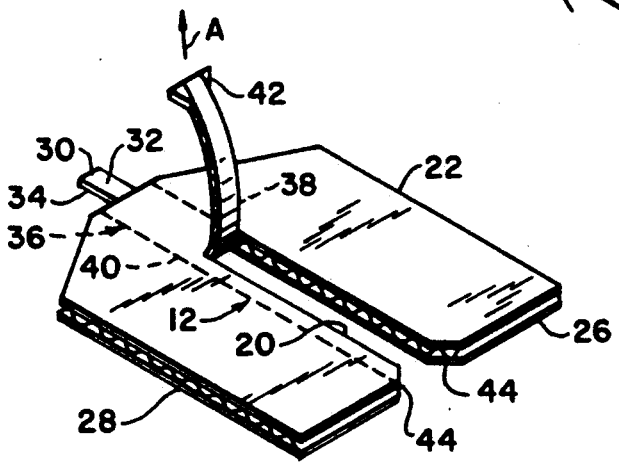
FIG. 3 is a perspective view of a panel of the carton of FIG. 1, showing the tear tape opening system therein.
Figure 4:
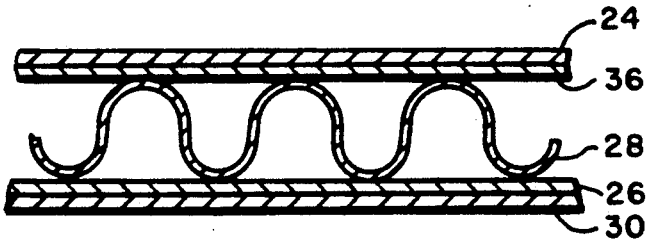
FIG. 4 is an enlarged cross-sectional view of the corrugated board incorporating the tear tape opening system of the present invention.

Turning now to FIG. 3, therein is shown a corrugated board panel, designated 22, of carton 10 having outside and inside liners 24 and 26, respectively, and corrugations or corrugating medium 28 thereinbetween. As clearly seen in FIGS. 3 and 4, tear tape opening system 12 consists of a tear tape 30 having upper and lower edges 32 and 34, respectively, adhered to the outside surface of inside liner 26 along the desired opening line and a tear guide tape, designated 36, having upper and lower edges 38 and 40, respectively, adhered to the inside surface of outside liner 24 of panel 22. In order to create an even tear line 20, it is necessary that at least lower edge 34 of tear tape 30 underlie guide tape 36 while upper edge 32 of tear tape 30 is preferably in registration with upper edge 38 of guide tape 36. Guide tape 36 has no weft or cross-machine direction strength and together with the machine direction strength of the guide tape permits the tearing thereof along tear line 20 while also providing edge reinforcing therealong. Both tear tape 30 and tear guide tape 36 may be formed of contiguous strands of polyester yarn coated and impregnated with hot melt adhesive. In order to operate the tear tape opening system, the user grasps pull tab 42, formed by die cuts 44, and pulls outwardly and upwardly in the direction generally indicated by arrow A. Tear tape 30 is thereby caused to tear through inside liner 26, corrugation 28, tear guide tape 36, and outside liner 24. Tear line 20 is guided in the lower section of panel 22 by means of guide tape 36 so that outside liner 24 is caused to tear substantially evenly, resulting in an even tear along tear line 20.

Figure 5:
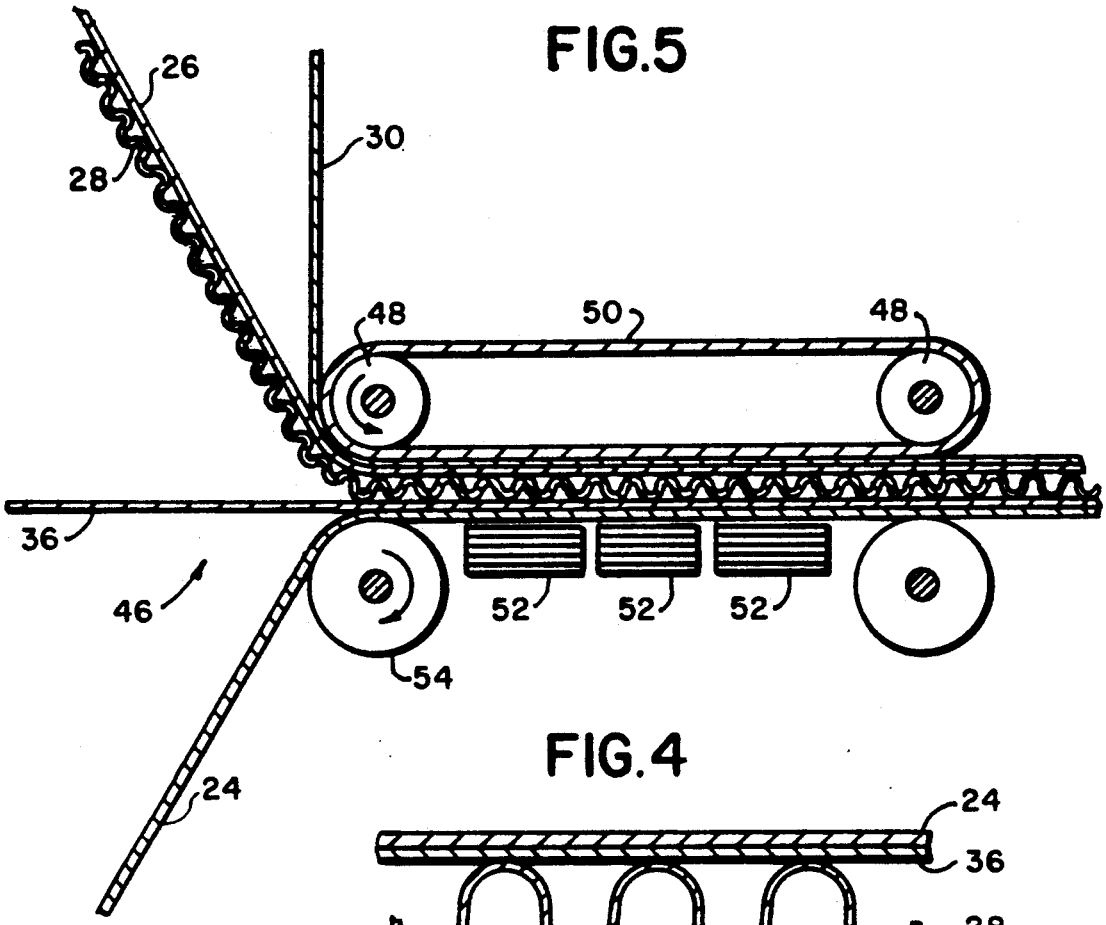
FIG. 5 is a schematic view of a portion of the machine utilized in the formation of corrugated board.

In FIG. 5, there is shown the doublebacker section, designated 46, of a corrugated board-forming machine where inside liner 26 adhered to the flutes of one side of corrugating medium 28 is fed between pressure rolls 48 driving pressure belt 50 and hot plates 52, and outside liner 24 is applied to the opposing flutes of corrugations 28 by being fed into the nip of roller 54. Thus, outside liner 24, corrugations 28 and inside liner 26 are sandwiched between pressure belt 50 and hot plates 52. Upstream from the doublebacker section (not shown), an adhesive is applied to the flutes of corrugations 28, which is heat activated so that when the three elements pass between pressure belt 50 and hot plates 52, the outside liner is firmly adhered to corrugations 28. Tear tape 30 is applied to the outside surface of inside liner 26 by feeding it into the nip between inside liner 26 and pressure rolls 48. Tear tape 30 may be a hot melt coated tape or string having a paper backing thereon to prevent smearing of the hot melt or transfer of the hot melt to belt 50 as a result of the heat generated by hot plates 52. Instead of using a paper backing to protect the hot melt of the tear tape, it is also possible to utilize a differential hot melt, wherein a higher temperature hot melt is used on the side of tear tape 30 facing pressure belt 50 which would be unaffected by the heat from hot plates 52. As can be seen from FIG. 5, there is no problem created by having guide tape 36 a hot melt coated tape since the tape is sandwiched between corrugations 28 and outside liner 24 so there is no problem of transfer of the hot melt and smearing is also not a problem since appearance is not a concern.

Figure 6:
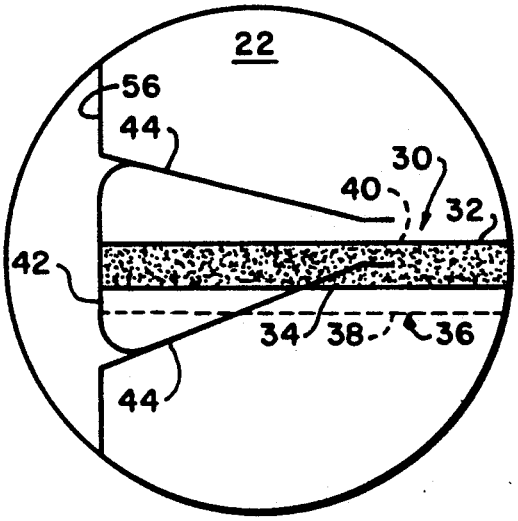
FIG. 6 is an enlarged view of the inside surface of the carton of FIG. 1 showing the opening tab of the tear tape opening system.

FIG. 6 is a view of the inside surface of panel 22 showing opening tab 42 and opening system 12. Opening tab 42 is formed by a pair of converging die cuts 44 which are made into panel 22 at an edge 56 thereof at opening system 12. It is necessary for at least the lower one of die cuts 44 to intersect or nip through tear tape 30 and tear guide tape 36 so that when opening tab 42 is pulled during opening, the propagation of tear line 20 continues from the intersecting die cut 44. Preferably, the tear guide tape 36 is 7/16 inches and the tear tape 30 is ¼ inch and the positioning of the intersecting die cut 44 allows at least ⅛ inch of the width of the tear tape to be utilized for opening purposes. This permits a limited amount of leeway in the positioning of die cuts 44 of tab 42 amounting to about ⅛ inch.

While only a single embodiment of the present invention has been described and shown, it is obvious that many changes and modifications may be made thereunto without departing from the spirit and scope of the present invention.

What is claimed is:

1. A tear tape opening system for establishing an opening having at least one even tear line in a package or carton having a top and bottom and formed of corrugated board, the corrugated board having an outside liner, an inside liner, and corrugations thereinbetween, the outside and inside liners each having outside and inside surfaces, the inside surfaces of the outside and inside liners facing and being adhered to the corrugations, the formation of the corrugated board including the step of joining the outside liner to a side of the corrugations wherein an opposite side of the corrugations is attached to the inside liner and the corrugated board passes between a pressure belt and a heating means wherein the heating means contact the outside liner and the pressure belt the inside liner, said tear tape opening system comprising:

a tear tape having top and bottom edges arranged parallel to the top and bottom, respectively, of the carton, said tear tape consisting of a hot melt coated tape adhered to the outside surface of the inside liner along the desired line of opening by being heated by the heating means thus softening the hot melt and being pressed onto the outside surface of the inside liner by the pressure belt;

a tear guide tape at least as wide as said tear tape and having top and bottom edges arranged parallel to the top and bottom, respectively, of the carton, said tear guide tape being adhered to the inside surface of the outside liner of the corrugated board along the desired line of opening, at least one of said top and bottom edges of said tear tape underlying in projection said tear guide tape; and means for preventing the hot melt of said tear tape when softened from being smeared or transferred to the pressure belt during adherence to the outside surface of the inside liner.

2. The tear tape opening system as defined in claim 1, wherein said tear guide tape is formed of a tape having no cross machine direction strength.

3. The tear tape opening system as defined in claim 1, wherein the tear tape and the tear guide tape extend circumferentially throughout the periphery of the carton so that when an opening is established by the tear tape opening system, the carton is separated into two sections at least one of which having an even tear line making that section suitable for a consumer display of product packaged in the carton.

4. The tear tape opening system as defined in claim 3, wherein one of the top and bottom edges of the tear tape corresponding to the tear line of the carton section of the consumer display underlies said tear guide tape.

5. The tear tape opening system as defined in claim 1, wherein the bottom edge of said tear tape underlies in projection said tear guide tape.

6. The tear tape opening system as defined in claim 5, wherein the top edges of said tear tape and said tear guide tape are in registration with one another.

7. The tear tape opening system as defined in claim 5, wherein the tear guide tape is wider than the tear tape.

8. The tear tape opening system as defined in claim 1, wherein the means for preventing the hot melt of said tear tape from being smeared or transferred to the pressure belt comprises said tear tape having a paper backing thereon.

9. The tear tape opening system as defined in claim 1, wherein the means for preventing the hot melt of said tear tape from being smeared or transferred to the pressure belt comprises said tear tape having a differential hot melt wherein the hot melt at the surface in contact with the pressure belt has a melting temperature unaffected by the heat of the heating means.

10. The tear tape opening system as defined in claim 1, which further comprises a pull tab for initiating the opening of the opening system formed by a pair of die cuts at an edge of the corrugated board wherein at least one of said die cuts nips through said tear tape and said tear guide tape.

11. The tear tape opening system as defined in claim 10, wherein at least one half of said tear tape lies between said die cuts.

12. A method for forming a tear tape opening system for establishing an opening having at least one even tear line in a package or carton having a top and bottom and formed of corrugated board, the corrugated board having an outside liner, an inside liner, and corrugations thereinbetween, the outside and inside liners each having outside and inside surfaces, the inside surfaces of the outside and inside liners facing and being adhered to the corrugations, the formation of the corrugated board including the step of joining the outside liner to a side of the corrugations wherein an opposite side of the corrugations is attached to the inside liner and the corrugated board passes between a pressure belt and a heating means wherein the heating means contact the outside liner and the pressure belt the inside liner, the tear tape opening system including a tear tape and a tear guide tape, said method comprising:

feeding the tear tape consisting of hot melt coated paper backed tape having top and bottom edges to be arranged parallel to the top and bottom, respectively, of the carton, between the pressure belt and the inside liner;

adhering the tear tape to the outside surface of the inside liner along the desired line of opening by heating by the heating means which soften the hot melt and pressing onto the outside surface of the inside liner by the pressure belt;

feeding the tear guide tape which is at least as wide as said tear tape with top and bottom edges to be arranged parallel to the top and bottom, respectively, of the carton, between the outside liner of the corrugated board and the corrugations along the desired line of opening, wherein one of the top and bottom edges of the tear tape underlies in projection the tear guide tape; and adhering the tear guide tape to the inside surface of the outside liner.

13. A method for forming a tear tape opening system for establishing an opening having at least one even tear line in a package or carton having a top and bottom and formed of corrugated board, the corrugated board having an outside liner, an inside liner, and corrugations thereinbetween, the outside and inside liners each having outside and inside surfaces, the inside surfaces of the outside and inside liners facing and being adhered to the corrugations, the formation of the corrugated board including the step of joining the outside liner to a side of the corrugations wherein an opposite side of the corrugations is attached to the inside liner and the corrugated board passes between a pressure belt and a heating means wherein the heating means contact the outside liner and the pressure belt the inside liner, the tear tape opening system including a tear tape and a tear guide tape, said method comprising:

feeding the tear tape consisting of hot melt coated tape having a differential hot melt coating and top and bottom edges to be arranged parallel to the top and bottom, respectively of the carton, between the pressure belt and the inside liner, the differential hot melt coating including a high temperature hot melt on the tape surface adjacent the pressure belt;

adhering the tear tape to the outside surface of the inside liner along the desired line of opening by heating by the heating means which soften the low temperature hot melt but not the high temperature hot melt and pressing onto the outside surface of the inside liner by the pressure belt;

feeding the tear guide tape which is at least as wide as said tear tape with top and bottom edges to be arranged parallel to the top and bottom, respectively, of the carton, between the outside liner of the corrugated board and the corrugations along the desired line of opening, wherein one of the top and bottom edges of the tear tape underlies in projection the tear guide tape; and adhering the tear guide tape to the inside surface of the outside liner.

* * * * *